United States Patent [19]

Schwiers et al.

[11] 4,439,894

[45] Apr. 3, 1984

[54] DOOR-OPERATED SAFETY SHUTOFF SYSTEM

[75] Inventors: Friedrich-Wilhelm Schwiers; Trützschler, both of Monchen-Gladbach, Fed. Rep. of Germany

[73] Assignee: Trützschler GmbH & Co. KG, Monchen-Gladbach, Fed. Rep. of Germany

[21] Appl. No.: 301,323

[22] Filed: Sep. 11, 1981

[30] Foreign Application Priority Data

Sep. 13, 1980 [DE] Fed. Rep. of Germany ..... 3034589

[51] Int. Cl.[3] ..... F16P 3/08; D01G 31/00

[52] U.S. Cl. ..... 19/0.2; 19/80 R; 19/98; 19/200

[58] Field of Search ..... 19/0.2, 80 R, 98, 99; 200/61.43, 61.62, 83 N, DIG. 43

[56] References Cited

U.S. PATENT DOCUMENTS

| | | | |
|---|---|---|---|
| 3,303,303 | 2/1967 | Miller | 200/61.43 |
| 3,814,877 | 6/1974 | Aluarez | 200/83 N |
| 4,238,651 | 12/1980 | Tann | 200/83 N |

FOREIGN PATENT DOCUMENTS

| | | | |
|---|---|---|---|
| 2058269 | 4/1981 | United Kingdom | 19/98 |

*Primary Examiner*—Louis Rimrodt

*Attorney, Agent, or Firm*—Spencer & Frank

[57] ABSTRACT

A safety system operatively connected with a door, includes an air line, a pressure difference generator communicating with the air line and operatively connected with the door for altering the pressure of air in the air line when the door moves from a closed position to an open position and a pressure-responsive switch operatively connected with the air line for presenting an output indication in response to the alteration of air pressure in the air line.

3 Claims, 9 Drawing Figures

DOOR-OPERATED SAFETY SHUTOFF SYSTEM

BACKGROUND OF THE INVENTION

This invention relates to a safety system for the openable doors, lids, panels and the like forming part of protective housings, particularly for textile machines such as cards, bale openers, cleaners, fine openers and the like. The machines have movable and/or moving components such as rotary shafts, cylinders and the like operated by machine drives. When the openable housing component (hereafter door) is opened, the system emits an electric signal for stopping the machine drive.

For safety reasons, when a door of the textile machines is opened, the current supply to the drive of the machine has to be interrupted and, significantly, as long as the door remains open, the drive should not be able to be restarted. For this purpose, switching components which are coupled with the door,operate safety limit switches which interrupt the current supply. Such limit switches have to be electrically wired and installed at substantial structural expense.

SUMMARY OF THE INVENTION

It is an object of the invention to provide a safety system which is inexpensive, which is easy to install and which has a simple structure.

This object and others to become apparent as the specification progresses, are accomplished by the invention, according to which, briefly stated, the housing door is associated with at least one pneumatic pressure difference generator which is coupled with an air line containing, as a signal transmitter, an electro-pneumatic pressure-responsive switch.

Basically, the invention provides a pneumatic-electric safety system in which, in the immediate vicinity of the door, an air line is provided. With each door there is associated a pressure difference generator coupled to the air line. Further, the air line contains an electro-pneumatic pressure-responsive switch (hereafter pressure switch) which, upon pressure alterations in the air line, emits an electric signal. Thus, an important aspect of the system is the appearance of a pressure difference, that is, a transition from a higher pressure to a lower pressure or conversely. If, for example, a door of the machine housing is opened, the associated pressure difference generator effects a change in the pressure prevailing in the air line. This pressure change causes the pressure switch to present an output indication resulting in a shutoff of the machine drive which will immediately come to a standstill if no large masses are being moved. The system according to the invention is of simple construction and has no limit switches. As concerns manufacturing technology, the system has the particular advantage that a usually already-existing air line—by means of which, for example, pipe switches in pneumatic tube dispatchers are operated—can be used and thus a wiring and installation of a limit switch may be dispensed with. It is a further particular advantage of the system according to the invention that it operates with superior reliability. Not only upon opening of a door but also in case of other pressure changes caused, for example, when damages or leaks in the air line or the pressure difference generator occur, a shutoff of the machine drive will immediately result.

According to a preferred embodiment of the invention the air line forms part of a closed system; it thus operates without an additional external air source. The pressure difference generator which is coupled to the air line comprises, as a contact element, a compressible component, which is made, for example, of rubber and which cooperates with a door. As long as the door is closed, the rubber member is compressed and when the door is opened, the rubber member expands, resulting in an expansion of the air in the line. This leads to a pressure difference which is applied to the pressure switch contained in the air line. The pressure switch emits an electric signal by means of which the machine drive is turned off. It is, however, feasible to so arrange the system that the rubber member is in a relaxed, expanded state when the machine door is closed and upon opening of the door the rubber member is compressed, causing an electric signal to be emitted by the pressure switch.

According to another embodiment of the invention, the air line is coupled to an external air pressure source which may be part of an already-existing pressurized air system. In the air line there prevails, for example, a pressure which is higher than the ambient pressure externally of the air line. Preferably, the pressure difference generator comprises a closure element which is associated with a nipple of the air line and which is mounted on the machine door. Thus, in such a case the pressure difference generator is a separable two-part component. Expediently, between the nipple and the closure element a rubber seal is provided. If the door is opened, the closure element moves away from the nipple (or a valve plunger opens a valve) thereby opening the air line. As a result, the pressure in the air line drops, for example, to the ambient surrounding pressure. The thus-obtained pressure difference affects the pressure switch which emits an electric signal to shut off the machine drive. Preferably, between the air pressure source and the air line there is arranged a solenoid valve which is expediently actuated by a push button arranged in a central control panel. According to one preferred embodiment of the invention, the solenoid valve is opened to permit the pressurized air to flow into the air line. As soon as the air line is filled with pressurized air, the pressure switch generates a signal which causes a circuit breaker in the machine drive circuit to be closed and which, at the same time, shuts off the solenoid valve. According to another preferred embodiment, the solenoid valve, after all the doors are closed, opens and remains open even after the air line has been filled with pressurized air. Upon pressure drop in the air line which occurs, for example, when one of the doors is opened or a leakage in the air line occurs, the solenoid valve is closed upon command of a signal emitted by the pressure switch so that no further pressurized air is supplied. In this manner unnecessary air consumption is avoided. The opening and closing of the solenoid valve may be effected automatically.

It is an important aspect of the safety system that the machine cannot be operated as long as the door is in an open state (prevention of circuit closing). Preferably, the air line forms a closed circuit. The invention may be used in connection with components of a larger system or several systems may be provided with a sole safety circuit according to the invention. Preferably, the safety system according to the invention is driven with a low air pressure which is maintained within the system at an as constant a level as possible.

DESCRIPTION OF THE PREFERRED EMBODIMENTS

Figure 1:
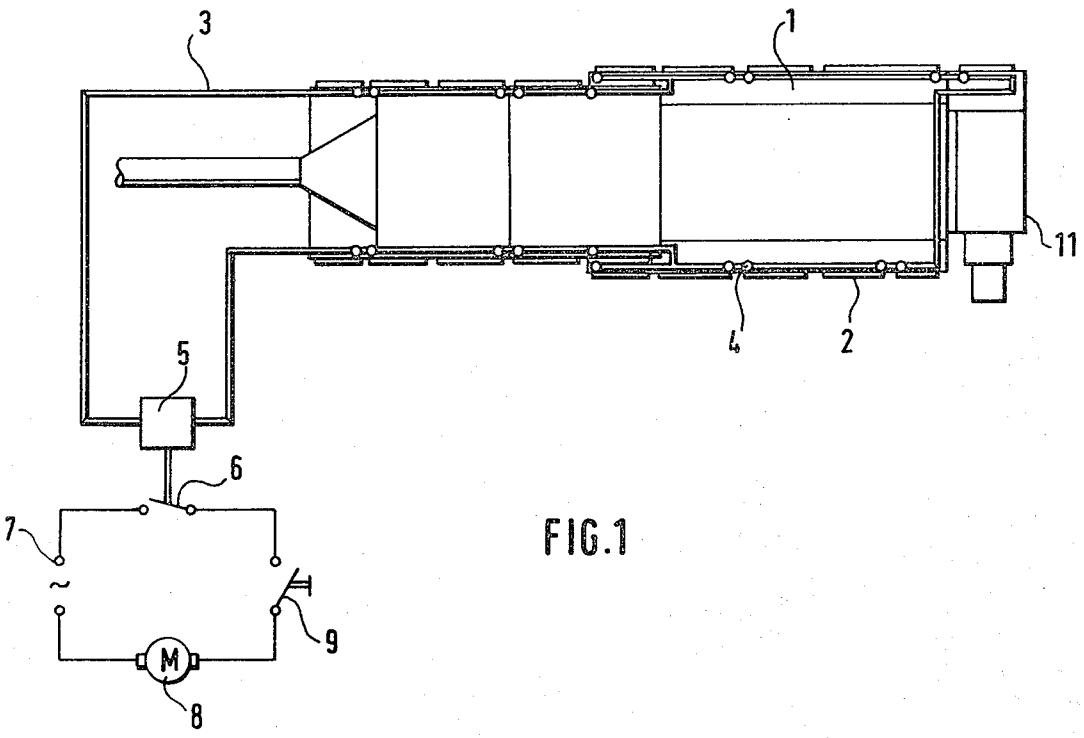
FIG. 1 is a schematic plan view of a textile machine incorporating a safety system according to the invention.

Turning now to FIG. 1, there is illustrated a textile machine 1 which is, for example, a pneumatic fiber tuft feeder. The textile machine 1 has a sheet metal housing 11 comprising a plurality of doors 2 which for safety reasons prevent access to rotating shafts, cylinders and the like. In the immediate vicinity of the doors 2 there extends an air line 3 which is adapted to carry pressurized air in a closed loop. At the individual doors 2 small circles in the drawing indicate the location where a pneumatic pressure difference generator 4 is mounted. The air line 3 includes an electro-pneumatic pressure switch 5 which is connected with a circuit breaker relay 6. The relay 6 is a component of an electric circuit which further has a voltage source 7, a motor 8 constituting the drive for the textile machine 1 and a main motor switch 9.

Figure 2A:
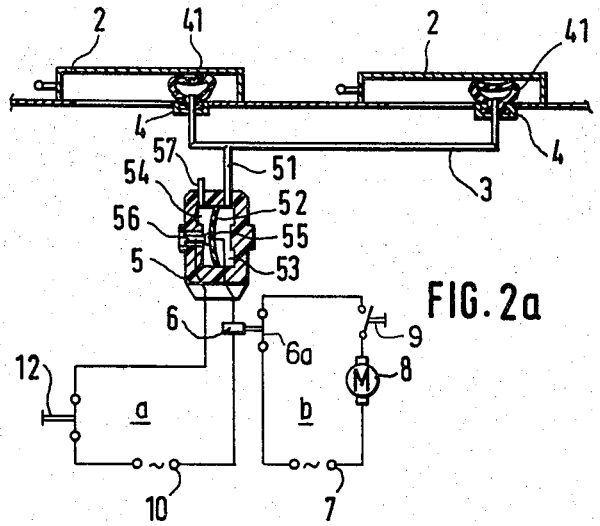
FIGS. 2*a* and 2*b* are schematic sectional views of a preferred embodiment of the invention shown in an inoperative and operative state, respectively.
Figure 2B:
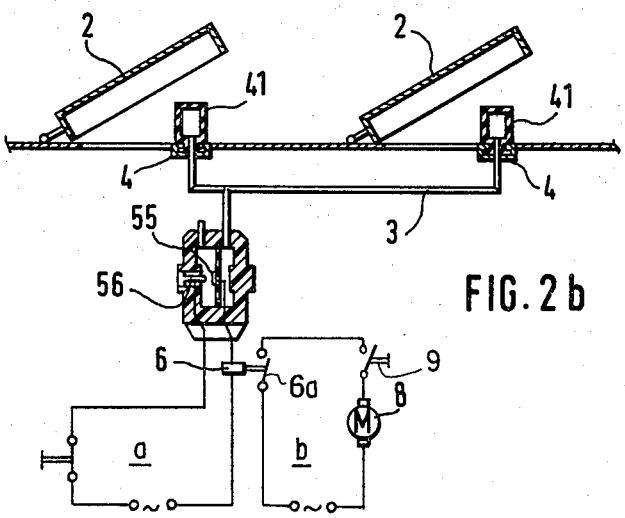

Turning now to FIGS. 2*a* and 2*b*, with the inner face of each door 2 there cooperates a separate pressure difference generator 4 comprising, as a contact element, a hollow compressible rubber member 41. The pneumatically operated pressure switch 5 has an inner space which is divided into two chambers 53 and 54 by means of a resilient (rubber) diaphragm 52. Approximately in the middle of the diaphragm 52 there is provided a metal contact plate 55 which is electrically connected with the relay 6. In a wall of the chamber 54 there is mounted a contact pin 56 which cooperates with the contact plate 55 and which is electrically connected with the relay 6. The pressure difference generators 4 communicate with a common closed (sealed) air line 3 which, by means of a conduit 51 communicates with the chamber 53 of the pressure switch 5. The chamber 54 of the pressure switch 5 has an air release nipple 57 for pressure equalization. The relay 6 is connected in a first circuit a which has a control voltage source 10 and a circuit breaker 12. The relay 6 operates a circuit breaker 6*a* of a second circuit b in which the machine drive motor 8, the drive voltage source 7 and the motor switch 9 are connected.

FIG. 2*a* shows the safety system in an inoperative state, that is, the doors 2 are closed and the relay 6 maintains the circuit b closed, whereby the motor 8 may be operated by the switch 9. By virtue of the closed position of the doors 2 the respective compressible members 41 of the pressure difference generators 4 are in a compressed condition, so that from the air line 3 pressurized system air is communicated to the chamber 53 of the pressure switch 5. As a result, the diaphragm 52 is deformed towards the contact pin 56, whereby the contact plate 55 mounted on the diaphragm 52 is in an electric contact with the contact pin 56. By closing the circuit breaker 12, the first circuit a is closed, whereby the relay 6 is energized, maintaining the circuit breaker 6*a* closed, so that the motor 8 may be operated.

FIG. 2*b* shows the doors 2 open. The compressible rubber members 41 of the pressure difference generators 4 expand as the doors 2 are opened, causing an expansion (pressure drop) of the air in the air line 3. As a result, the pressure in the chamber 53 drops and the diaphragm 52 moves towards the right by virtue of its own resiliency from its position shown in FIG. 2*a* into its new position shown in FIG. 2*b*, whereby the contact plate 55 moves away from the contact pin 56. As a result, the circuit a is interrupted, thereby deenergizing the relay 6 which in turn opens the circuit b thus shutting off the motor 8. It is to be understood that the same sequence of events takes place even if only a single door 2 is opened.

Figure 3A:
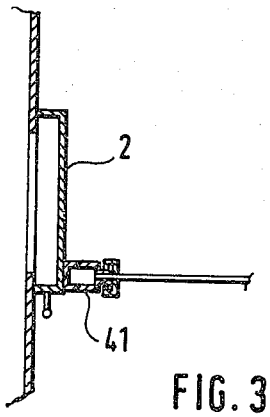
FIGS. 3*a* and 3*b* are sectional views of a component of the preferred embodiment in the inoperative and operative state, respectively.
Figure 3B:
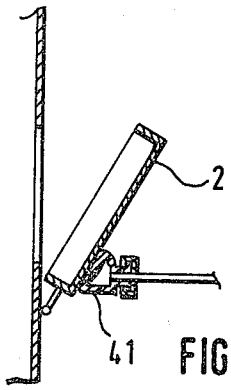

Turning now to a variant shown in FIGS. 3*a* and 3*b*, the compressible member 41 of the pressure difference generator 4 cooperates with the outer face of the door 2. While in the closed position of the door 2 the compressible member is in a relaxed, expanded state (FIG. 3*a*), the compressible member 41 is pressed together when the door is opened (FIG. 3*b*). The air pressure increase and decrease with the corresponding signal transmission is thus reversed as compared to the operation described in connection with FIGS. 2*a* and 2*b* and the cooperating parts of the pressure switch 5 may be reversed accordingly to effect signalling when a door 2 is opened.

Figure 4A:
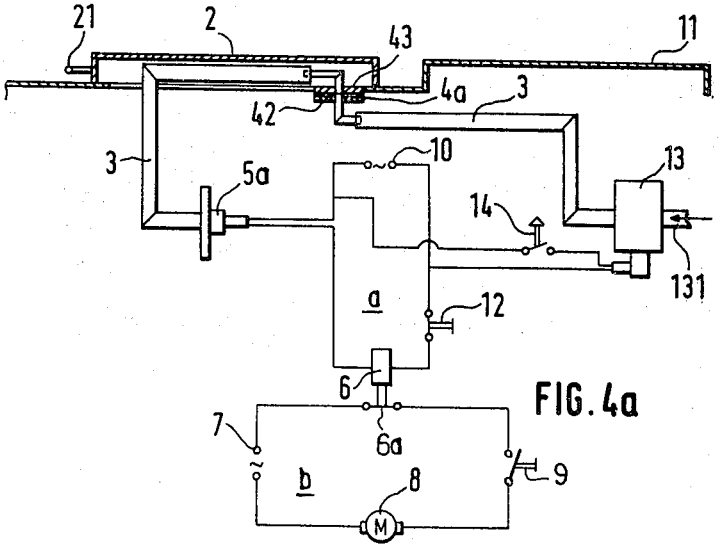
FIGS. 4*a* and 4*b* are schematic sectional views of a further preferred embodiment of the invention shown in an inoperative and operative state, respectively.
Figure 4B:
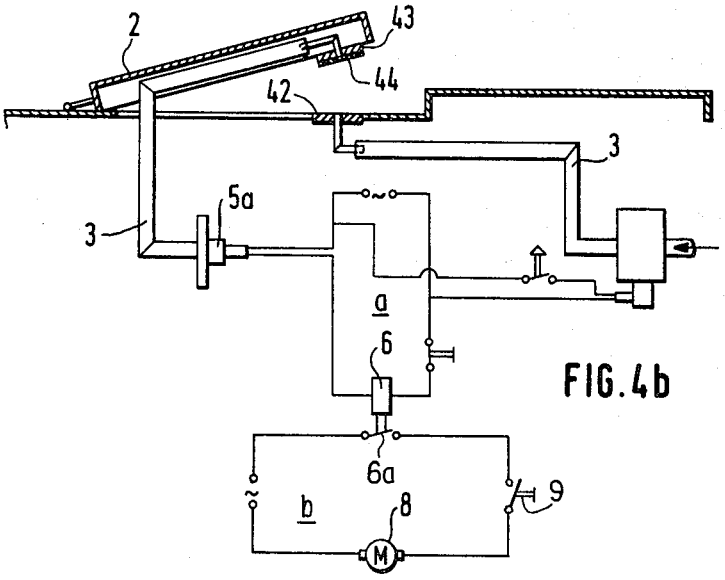

Turning now to FIGS. 4*a* and 4*b*, at the inner side of the door 2, on an end opposite a door hinge 21, there is arranged a two-part pressure difference generator 4*a* which is formed of a coupling nipple 42 mounted on the air line 3 and a closure element 43 mounted on the door 2. A rubber seal 44 is arranged between the components 42 and 43. With the air line 3 there is coupled, by means of an air nipple 131, a solenoid valve 13 known by itself. The air line 3 is connected with an electro-pneumatic pressure switch 5*a* which may be an electronic proximity switch operating without mechanical contacting. The switch 5*a* may be of the type described, for example, in German Patent No. 2,711,346 to which corresponds U.S. Pat. No. 4,211,935. The pressure switch 5*a* is connected in the circuit a, similarly to the embodiment described in connection with FIGS. 2*a* and 2*b*. In the circuit a there are further connected the solenoid valve 13 and a push button switch 14. The relay 6 opens or closes the circuit b which contains the circuit breaker 6*a*, the drive voltage source 7, the motor 8 and the motor switch 9.

FIG. 4*a* shows the safety system with the door 2 and the circuit breaker 12 closed. By operating the push button 14, the solenoid valve 13 is opened so that pressurized air may be introduced through the pressurized air nipple 131 into the air line 3 in the direction of the arrow. The pressure difference generator 4*a* responds and the pressure switch 5*a* emits an electric signal, whereupon the relay 6 is energized, for example, with the intermediary of a protective circuit breaker (not shown), whereby the circuit breaker 6*a* is closed, thus permitting the motor 8 to be energized. Thereupon the push button 14 may be again operated to close the solenoid valve 13, whereby the pressurized air supply is shut off.

If, as shown in FIG. 4*b*, the door 2 is opened, by means of the separation of the closure element 43 from the coupling nipple 42, the air line 3 is opened (interrupted) so that the pressure in the air line 3 drops to ambient air pressure. This causes the pressure switch 5*a* to open (that is, the pressure switch 5*a* stops transmitting signals), resulting in an opening of the circuit a. Thus, the relay 6 is deenergized, the circuit breaker 6*a* opens the circuit b, whereby supply of current to the motor 8 is prevented.

Figure 5:
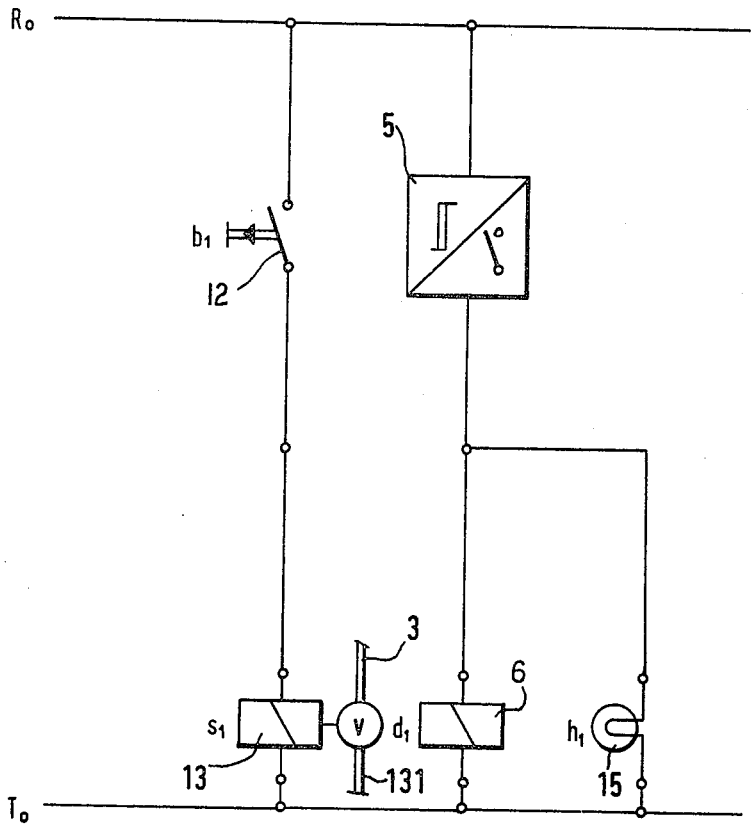
FIG. 5 is a diagram of a circuit for a system according to the invention for supplying air solely for pressure build-up.

FIG. 5 shows a circuit for a system which is described in connection with FIGS. 4*a* and 4*b* and in which pressurized air is introduced into the air line 3 only for building up the air pressure in the safety system. Lines $R_oT_o$ supply voltage to the circuit. A signalling lamp 15 indicates when the pressure in the air line 3 has reached a value such that the pressure switch 5*a* starts emitting electric signals. The machine may be started by closing the switch 12 of the motor 8.

Figure 6:
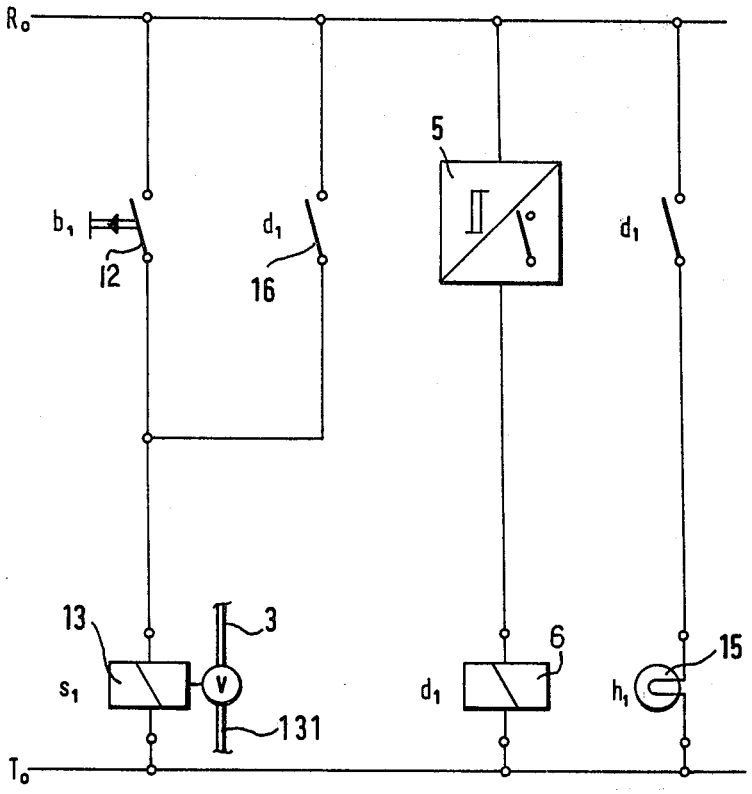
FIG. 6 is a diagram of a circuit for a system according to the invention for the continuous supply of pressurized air.

Turning now to FIG. 6, there is shown a circuit for a system in which pressurized air is continuously introduced through the coupling nipple 131 into the air line 3. The solenoid valve 13, upon pressure drop in the air line 3, closes the coupling nipple 131 and thus interrupts air supply. For this purpose, the switch 12 is associated with a holding relay 16 which maintains the solenoid valve 13 energized.

It will be understood that the above description of the present invention is susceptible to various modifications, changes and adaptations, and the same are intended to be comprehended within the meaning and range of equivalents of the appended claims.

What is claimed is:

1. A safety system for a textile machine, said textile machine having a housing, a door mounted on the housing and having open and closed positions; a drive motor for operating components of said textile machine, an electric power circuit connected to said motor for supplying electric current thereto; said safety system being operatively connected with said door for presenting different output indications for said open position and said closed position; the improvement in said safety system comprising (a) an air line;

(b) a pressure difference generator communicating with said air line and operatively connected with said door for altering the pressure of air in said air line when said door moves from said closed position to said open position;

(c) a pressure-responsive switch operatively connected with said air line for presenting an output indication in response to the alteration of air pressure in said air line;

(d) a source of pressurized air connected to said air line; and (e) a solenoid valve connected between said source of pressurized air and said air line for controlling admission of air from said source to said air line; and (f) pressure drop responsive means coupled to said air line and said solenoid valve for shutting off said solenoid valve upon predetermined pressure drop in said air line.

2. A safety system as defined in claim 1, wherein said pressure difference generator comprises an outlet nipple coupled to said air line and a closing member cooperating with said outlet nipple and operated by said door for allowing air to escape from said air line through said nipple in the one position of said door and preventing escape of air from said air line through said nipple in the other position of said door.

3. A safety system as defined in claim 2, wherein said pressure difference generator further comprises a sealing member positioned between said nipple and said closing member.

* * * * *